US009010421B2

(12) United States Patent
Stukan et al.

(10) Patent No.: US 9,010,421 B2
(45) Date of Patent: Apr. 21, 2015

(54) FLOWPATH IDENTIFICATION AND CHARACTERIZATION

(75) Inventors: Mikhail Stukan, Al-Khobar (SA); Stephen Dyer, Al-Khobar (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 480 days.

(21) Appl. No.: 13/524,397

(22) Filed: Jun. 15, 2012

(65) Prior Publication Data

US 2013/0333882 A1 Dec. 19, 2013

(51) Int. Cl.

| | |
|---|---|
| ***E21B 43/16*** | (2006.01) |
| ***E21B 49/00*** | (2006.01) |
| ***E21B 47/10*** | (2012.01) |

(52) U.S. Cl.

CPC ..... *E21B 49/00* (2013.01); *E21B 43/162* (2013.01); *E21B 47/10* (2013.01)

(58) Field of Classification Search

CPC ..... E21B 43/162; E21B 47/10; E21B 49/00
USPC ..... 166/250.01, 252.4, 252.5, 252.6, 270
See application file for complete search history.

(56) References Cited

U.S. PATENT DOCUMENTS

| | | | | |
|---|---|---|---|---|
| 3,623,842 | A | 11/1971 | Deans | |
| 4,555,488 | A * | 11/1985 | Schmitt | 436/27 |
| 4,755,469 | A | 7/1988 | Showalter et al. | |
| 6,196,318 | B1 * | 3/2001 | Gong et al. | 166/308.2 |
| 6,668,922 | B2 * | 12/2003 | Ziauddin et al. | 166/250.05 |
| 7,114,567 | B2 * | 10/2006 | Chan et al. | 166/280.1 |
| 7,657,415 | B2 | 2/2010 | Panga et al. | |
| 8,162,048 | B2 | 4/2012 | Termine et al. | |
| 2002/0134587 | A1 | 9/2002 | Rester et al. | |
| 2004/0231842 | A1 | 11/2004 | Shammai et al. | |
| 2007/0012441 | A1 | 1/2007 | Heathman et al. | |
| 2007/0214878 | A1 | 9/2007 | Anderson | |
| 2008/0133193 | A1 | 6/2008 | Gdanski et al. | |
| 2009/0090505 | A1 | 4/2009 | McDaniel et al. | |
| 2009/0272531 | A1 | 11/2009 | Montaron | |

(Continued)

FOREIGN PATENT DOCUMENTS

| | | | |
|---|---|---|---|
| WO | 2007102023 | A1 | 9/2007 |
| WO | 2010041033 | A2 | 4/2010 |

OTHER PUBLICATIONS

International Search Report and Written Opinion for corresponding PCT Application Serial No. PCT/US2013/044090, dated Sep. 5, 2013, 11 pages.

*Primary Examiner* — Robert E Fuller
(74) *Attorney, Agent, or Firm* — Bridget Laffey; Jakub Michna; Daniel Matthews

(57) ABSTRACT

Systems and methods for analyzing produced fluids in a mature water flood (or EOR scheme) and determining whether the introduction of an EOR agent, such as a chemical or a gas additive, or some other alteration in treatment, is enhancing the recovery of hydrocarbon from parts of the reservoir otherwise untouched by injected fluids. The monitoring can be used to identify subtle changes in the produced fluid caused by their flow through different pore structures. In a carbonate formation for example, ions and salts from the rock fabric are dissolved into the reservoir fluids, whether they are water or oil. These can be detected by various fluid analysis and particularly water analysis methods. The changes in reservoir fluid paths associated with the injection of an EOR agent are detected in the observation well.

32 Claims, 6 Drawing Sheets

(56) References Cited

U.S. PATENT DOCUMENTS

2010/0234249 A1 9/2010 McDaniel et al.
2012/0118040 A1 5/2012 Difoggio et al.
2013/0032333 A1* 2/2013 Freese et al. ..... 166/246

* cited by examiner

FLOWPATH IDENTIFICATION AND CHARACTERIZATION

BACKGROUND

In enhanced oil recovery (EOR), it is desirable to know how the flow patterns in the formation are affected by the reservoir treatment applied. Since the ultimate goal is usually to sweep the oil from the inner rock structure it is important to know if the treatment diverts the flow paths in the matrix or on the contrary increases straight channeling between an injector well and a producer well. Additionally, it would be desirable to be able to monitor the evolution of the subterranean flow paths in real time as the treatment is being carried out.

Conventional tracer materials, such as radioactive isotopes and compounds like potassium iodide, ammonium thiocyanate and dichromate, have been used to determine the origination of fluids from different injectors within a full field flood. However, such techniques often rely on breakthrough to the observation well(s) before knowledge of the fluid flow path is determined. Additionally, methods are known for evaluating fracture geometry. Some, for example employ a radioactive proppant or fracturing fluid tracers combined with gamma-ray logs. Temperature based techniques are based on the comparison of the logs made before and after the treatment with an aim of defining the regions cooled by injection of the fracturing fluid. Other fracture geometry evaluation methods include using a borehole televiewer or acoustical methods.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments, a method is described of evaluating impact of a treatment scheme on production of reservoir fluids in a subterranean formation. The method includes: treating the hydrocarbon bearing subterranean formation in a first treatment phase, such as injecting water or some other fluid, to enhance hydrocarbon recovery from the formation; altering the treatment of the hydrocarbon bearing subterranean formation in a second treatment phase to further enhance hydrocarbon recovery, the second phase including injecting a fluid into the formation from an injection well; monitoring produced fluid being produced from the formation at a monitoring well, the monitoring including measuring quantities of formation material present in the produced fluid; and evaluating geometry characteristics, such as shape and/or size of pore spaces, of the flowpaths in the formation through which the produced fluid traveled based on the measuring of quantities of the formation material present in the produced fluid. According to some embodiments the injection and monitoring are performed from the same well. According to some embodiments, the effectiveness of the second phase for purposes of enhancing hydrocarbon recovery is evaluated based on whether the fluid produced during second phase originates from locations in the formation that were not treated during the first phase.

According to some embodiments the evaluation of the pathways is performed before the fluid injected during the second phase first reaches the monitoring well. According to some embodiments, pressure is monitored at both the injection well and the monitoring well during both the first and second phases. According to some embodiments, the evaluation of the flowpaths is based at least in part on a comparison of quantities of formation material measured during the first and second phases. According to some embodiments, the monitoring of the produced fluid is continuously carried out during the first and second phases. According to some embodiments, the produced fluid is sampled and monitored downhole in the monitoring well using a wireline tool. According to other embodiments, the produced fluid is monitored on the surface.

According to some embodiments, a system for evaluating impact of a treatment scheme on production of reservoir fluids in a subterranean formation is disclosed. The system includes a processing unit configured and programmed to receive first and second datasets representing measurements of quantities of rock formation material present in fluid produced in a producing well before and after an alteration to a fluid treatment scheme of the formation, and to evaluate geometry characteristics, such as shape and/or size of pore spaces, of flowpaths in the formation through which the produced fluid had traveled based on a comparison of the quantities of rock formation material present in the fluid before and after the alteration. According to some embodiments, the processing unit is further configured and programmed to evaluate effectiveness of the alteration for purposes of enhancing hydrocarbon recovery from the formation based in part on the comparison of the quantities of soluble components of rock formation material present in the fluid before and after the alteration. According to some embodiments, the system further comprises a fluid monitoring system such as a wireline tool adapted to make fluid samples downhole, or a surface-based monitoring system.

According to some embodiments, a method of evaluating a porous medium is described that includes: flowing a first fluid though the porous medium from an inlet to and outlet; altering the flowing of fluid through the porous medium; monitoring pressure between the inlet and outlet; measuring quantities of material from the porous medium present in fluid exiting the porous medium; comparing measured quantities of material from the porous medium present in fluid exiting the porous medium before and after the alteration; and evaluating characteristics of pore space flowpaths in the porous medium through which exiting fluid has traveled based on the comparison of measured quantities of material before and after the alteration. According to some embodiments, the inlet and outlet are in a single wellbore penetrating the porous medium.

BRIEF DESCRIPTION OF THE DRAWINGS

The subject disclosure is further described in the detailed description which follows, in reference to the noted plurality of drawings by way of non-limiting examples of embodiments of the subject disclosure, in which like reference numerals represent similar parts throughout the several views of the drawings, and wherein.

DETAILED DESCRIPTION

Figure 1:
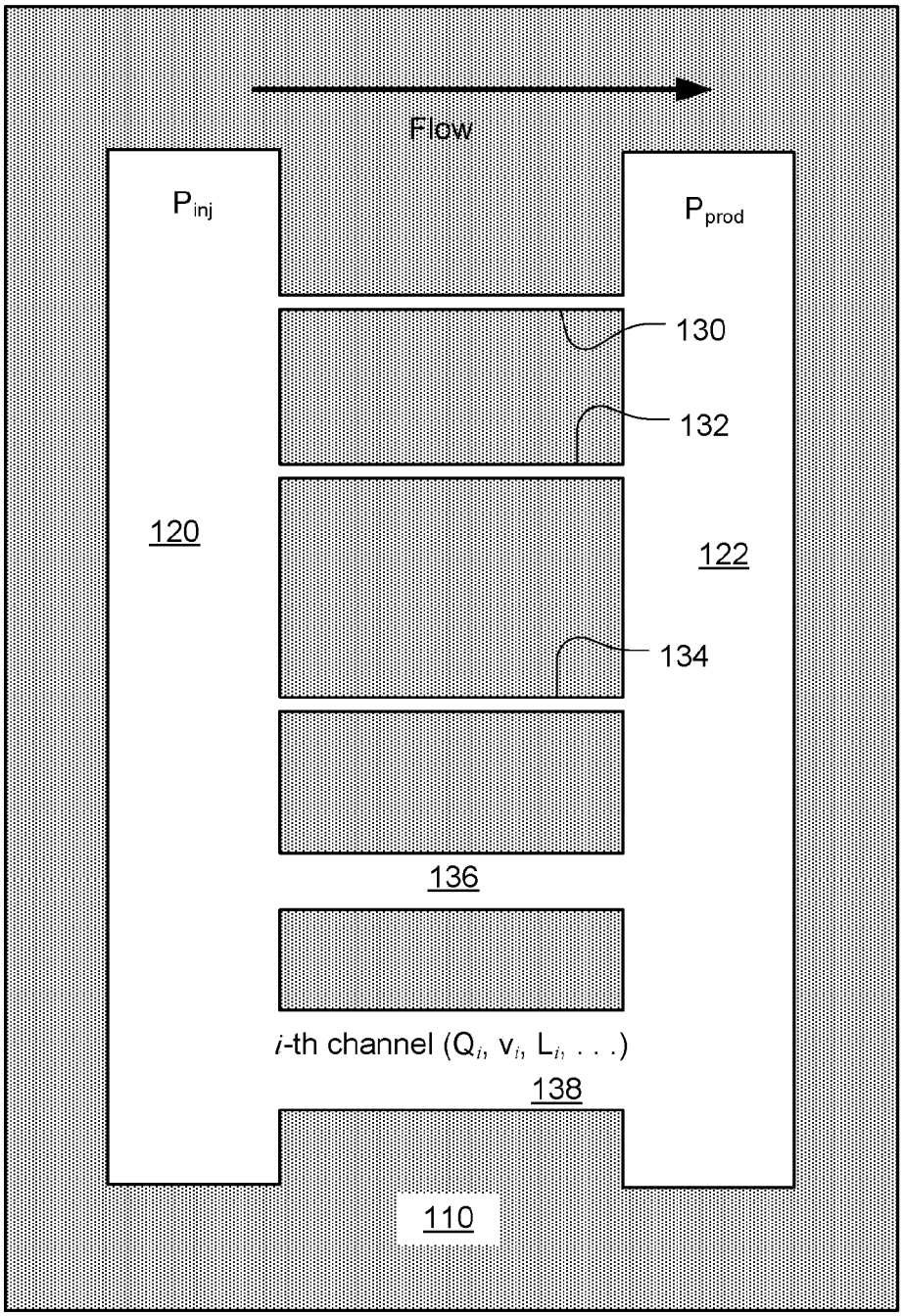
FIG. 1 illustrates a model of fluid flow between an injection well and a production well, according to some embodiments.

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details of the subject disclosure in more detail than is necessary for the fundamental understanding of the subject disclosure, the description taken with the drawings making apparent to those skilled in the art how the several forms of the subject disclosure may be embodied in practice. Further, like reference numbers and designations in the various drawings indicate like elements.

In enhanced oil recovery, it is desirable to know how the flow patterns in the formation are affected by the reservoir treatment applied. Since the ultimate goal is often to sweep the oil from the inner rock structure it is important to know if a given treatment diverts the flow paths in the matrix or on the contrary, increases straight channeling between injector and producer wells. According to some embodiments, the evolution of the subterranean flow paths can be monitored at the same time as the treatment.

According to some embodiments, a method for on-the-fly monitoring of the flow path evolution is described, by measuring at the production site the concentration of the formation material dissolved in the brine or fluids produced. This approach can afford a qualitative assessment of the effectiveness of the oil reservoir treatment.

Various embodiments described can be used in connection with many types of treatments. For example, embodiments can be used in connection with mature waterflood environments, as well as chemical, gas or other enhanced oil recovery techniques that target recovery of otherwise trapped hydrocarbons. According to some embodiments, a continuous analysis is carried out of the reservoir fluid in the production well. According to some embodiments, a relatively simple method for quantitative monitoring of the EOR flood efficiency "on the fly" is described.

According to some embodiments, analysis of the produced fluids in a mature water flood (or EOR scheme) is used to determine whether the introduction of an EOR agent—chemical, gas or other—is enhancing the recovery of hydrocarbon from parts of the reservoir otherwise untouched by injected fluids—for instance bypassed pay, specific rock types, tight porosity intervals etc.

According to some embodiments, the monitoring is used to identify subtle changes in the produced fluid caused by their flow through different pore structures. In a carbonate formation for example, ions and salts from the rock fabric are dissolved into the reservoir fluids, whether they be water or oil. These can be detected by various fluid analysis and particularly water analysis methods. The changes in reservoir fluid path associated with the injection of an EOR agent—for instance surfactant, miscible gases, "Smart Water," etc., are detected in the observation well.

If the rock fabric is known and the impact of the smaller tighter pore spaces where oil is trapped under conventional drainage can be modeled, then the expected change in chemistry of produced fluids can also be modeled. The method can be used to determine if the amount of fluid originated from these conventionally bypassed areas in the reservoir increases (being positively impacted by the EOR agent) before the EOR agent breaks through to the producer or observer wells.

According to some embodiments, applications of the described techniques can also be applied to conventional water flood, targeted chemical water flood—for instance different brine compositions or "Smart Water," surfactant or polymer or other chemical, miscible gas, steam or thermal methods, or combinations thereof.

According to some embodiments, the impact of cycling the injection fluids—for instance a huff-puff, or cyclical injection—such as water-alternating-gas (WAG), and simultaneous WAG (SWAG), or varying the injection amounts in time or in wells from injection can be determined. Cycling injection at different frequencies—can improve the placement of EOR agents in the formation and allow a "soak" period for instance with surfactants to imbibe or diffuse into matrix rock. The efficiency of this technique could be measured according to some embodiments.

According to some embodiments, the described techniques are used to determine from where fluids are recovered by the EOR agent, thereby providing a method to measure "EOR produced oil," which is a performance indicator, and can be used as a measure of the effectiveness of the EOR process itself.

According to some embodiments, further technology type applications benefiting from the described techniques include the following:

(1) Downhole or surface functionalized sensors or detectors designed to be triggered by certain small mineral and/or salt composition changes. According to some embodiments, monitoring of calcium or magnesium salts—e.g., Calcium Chloride, Magnesium Chloride, and/or Calcium/Magnesium Carbonate and Sulphate salts is performed. According to some embodiments, monitoring for functionalizing on the ions or Calcium and Magnesium can be provided.

(2) In small scale downhole pilots designed to target EOR fluid injection in specific intervals (e.g., Micro-pilot) or single well pilots, a measurement of the efficiency of the EOR treatment can be provided. These described techniques allow the efficiency of the EOR agent to be compared to regular water injection, and determination of whether fluid is being "mobilized" from otherwise non-producible parts of the reservoir.

(3) As well as for chemicals, the described techniques are very useful in determining whether a miscible gas flood—$CO_2$ or hydrocarbon—is displacing hydrocarbon from matrix pay effectively.

FIG. 1 illustrates a model of fluid flow between an injection well and a production well, according to some embodiments. The brine or other fluid on its way from the injection well 120 to the production well 122 finds its way through the rock structure 110. For simplicity five flow paths, 130, 132, 134, 136, and 138 are shown in FIG. 1, although in general there will be many more flow paths. Note that although the flow paths are shown straight and parallel to one another in FIG. 1 for simplicity, in general they can be anywhere in the formation and will not ordinarily be either straight or parallel to each other. The fluid follows various types of flow pathways: from thin capillaries to large fractures. On its way fluid dissolves the rock it contacts. Let us analyze how the concentration of the dissolved components in the fluid extracted from the production well depends on the path taken by this fluid through the rock. To do this we propose a simple model of parallel capillaries of different radii such as capillaries 130, 132, 134, 136 and 138.

If we denote pressure difference between injection and production wells as $\Delta P = P_{inj} - P_{prod}$ then the pressure gradient in the i-th capillary is $\Delta P/L_i$, where $L_i$ is the length of the i-th flow path. According to Hagen-Poiseuille equation volumetric flux in the i-th channel is:

$$Q_i = \frac{\pi R_i^4}{8\eta}\frac{\Delta P}{L_i} = \pi v_i R_i^2$$

where $R_i$ is the radius of the capillary, $v_i$ is the mean fluid velocity, and $\eta$ is the viscosity of the fluid. The amount of material dissolving in the fluid volume, $Q_i$ per unit of time, $\psi_i$, should be linearly proportional to the surface area of the rock in contact with the fluid, i.e., $\psi_i \propto \Pi_i\ v_i$, where $\Pi_i$ is the perimeter of the capillary (in case of circular capillary $\Pi_i=2\pi R_i$). If we assume that at any time the concentration of the rock material in the capillary fluid is much less than the saturated concentration i.e., $c_i \ll c_{sat}$, the dissolution will have the same intensity downstream. Thus, the amount of material dissolved in the fluid is expected to be linearly proportional to the time it takes fluid to pass through the capillary, $\tau_i=L_i/v_i$. Here we will consider the case when velocities are small and dissolution rate does not depend on $v_i$. In this case, at the end of the capillary the amount of the material dissolved in the volume of fluid corresponding to the volumetric flux is $\psi_i=\kappa\Pi_i v_i \tau_i=\kappa\Pi_i L_i$, where $\kappa$ is the dissolution coefficient. Thus concentration of the material near the production well is $$.c = \frac{\sum_i \psi_i}{\sum_i Q_i}$$

In case of circular capillaries this expression reads:

$$c = \frac{2\pi\kappa\sum_i R_i L_i}{\frac{\pi\Delta P}{8\eta}\sum_i \frac{R_i^4}{L_i}} = \frac{16\kappa\eta}{\Delta P}\frac{\sum_i R_i L_i}{\sum_i \frac{R_i^4}{L_i}}$$

From this expression we can see that if we maintain the same pressure difference between injector and collector the concentration of the material dissolved from the rock is higher when the total flow path consists of thin long capillaries.

An aspect of this technique is that it does not require injected fluids to breakthrough to the producing well. Rather it makes use of control of the pressure between the injector and producing well. If the pressures are constant, or the pressure differential remains constant (assuming that the impact of absolute system pressure on solid dissolution rates, or fluid compositions is minimal), then the described technique allows for a determination of whether or not the injected EOR agent is actively releasing hydrocarbons from parts of the reservoir that was not contacted until the onset of this fluid injection.

This determination, according to some embodiments can be used in single well or well-to-well pilots, where the interest is whether or not oil is producing from lower permeable matrix pay where the pore throats are generally smaller and of higher surface area than in highly permeable pay. According to some embodiments, this technique is used in conjunction with a downhole injection and downhole sampling tool, such as Schlumberger's MDT, to determine the efficiency of a certain type of EOR agent in recovering fluids from lower permeability pay. According to some embodiments, the described techniques are used in connection with a small scale targeted zone EOR evaluation such as Schlumberger's MicroPilot service.

According to some embodiments, the described techniques are used in connection with multi-well pilots where the producer well is monitored for certain ionic composition changes. These changes are then used to determine the efficacy of an injected EOR agent into the neighboring injector well. According to some embodiments, a single well is used for both EOR agent injection and production monitoring.

According to some embodiments, the mathematical techniques described herein are readily portable to various types of simulation techniques that are capable of determining "residence time" of fluids in any of the simulator grid cells. According to some embodiments, the residence time is coupled with a reaction kinetics experimental data to determine theoretical dissolved ion content, and used as a match parameter when trying to determine the injected fluid front.

Figure 2A:
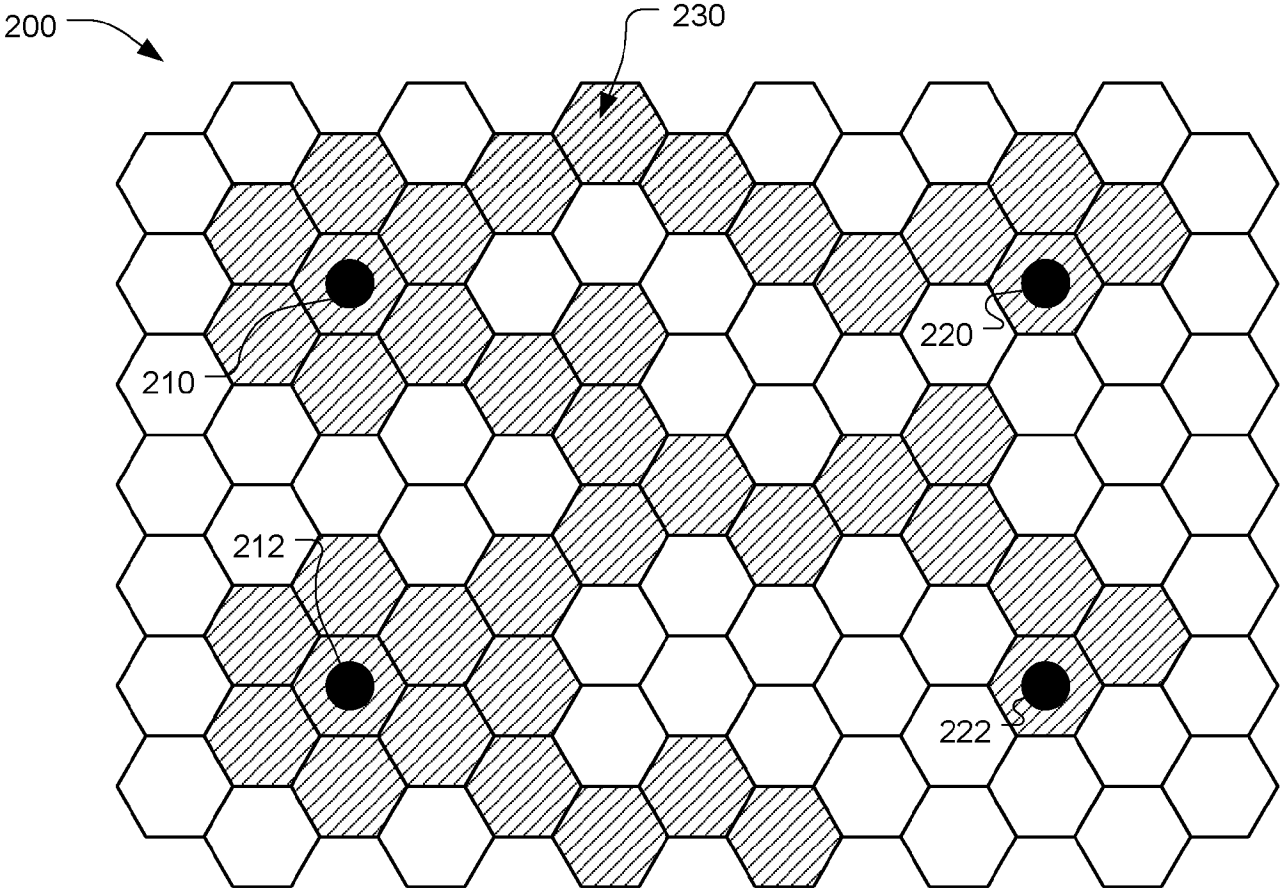
FIGS. 2A-2C are diagrams illustrating a representation of various stages of a mature water flood and an injection EOR treatment, according to some embodiments.
Figure 2B:
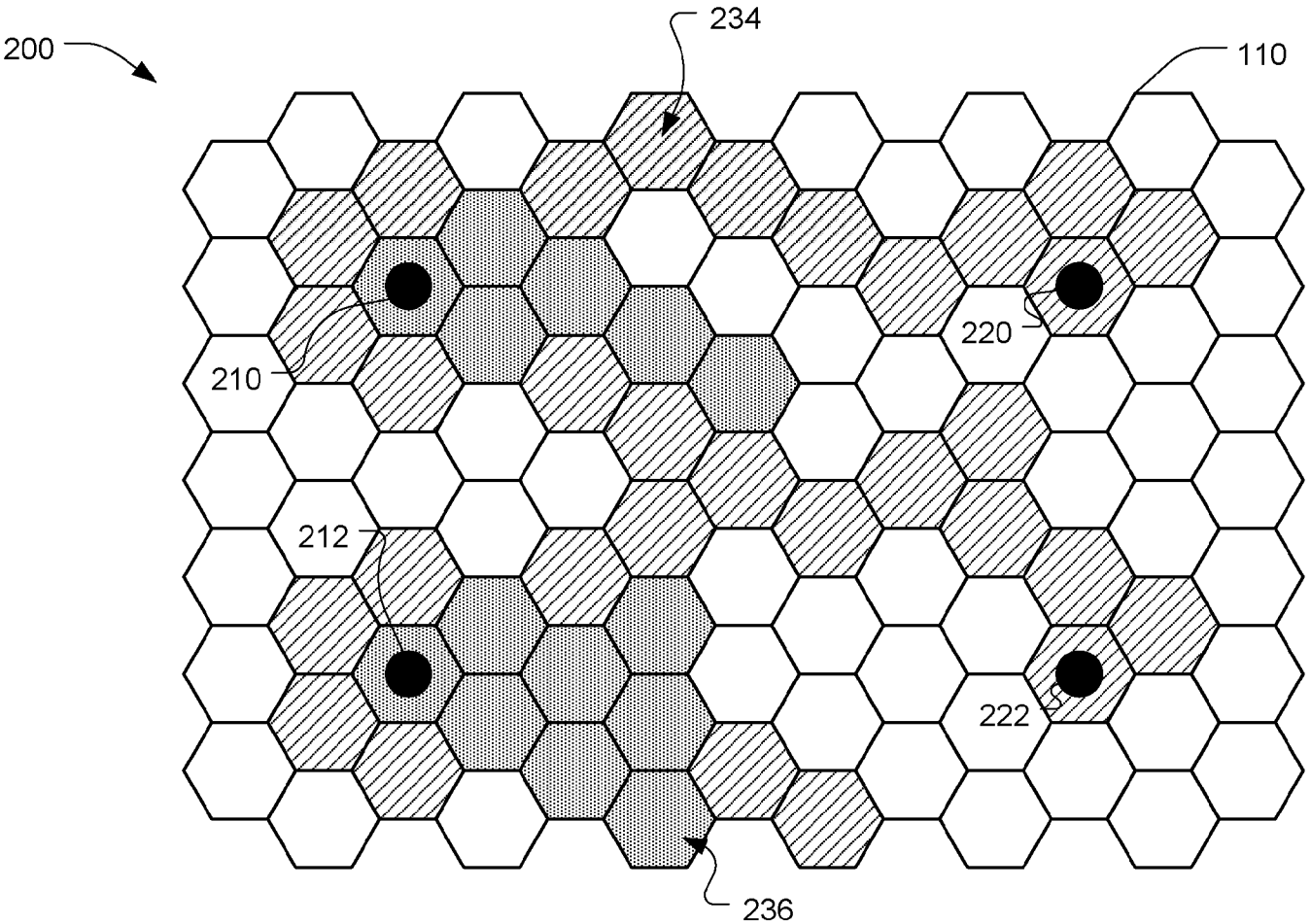
Figure 2C:
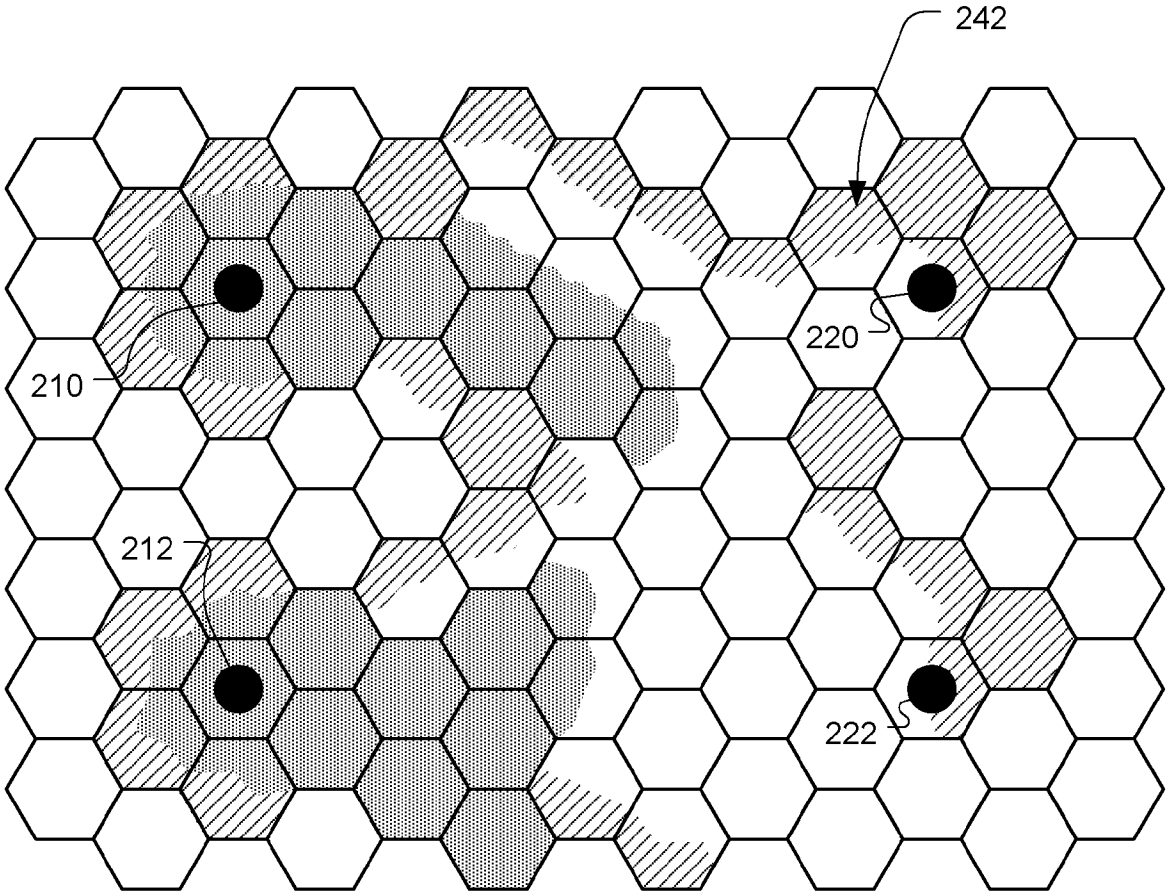

FIGS. 2A-2C are diagrams illustrating a representation of various stages of a mature water flood and an injection EOR treatment, according to some embodiments. FIG. 2A shows a portion of a subterranean rock formation 200 during a mature water flood, but prior to a subsequent injection EOR treatment. A series of injector wells, including injector wells 210 and 212 are used for injection of a first phase of an Incremental Oil Recovery (IOR) or Enhanced Oil Recovery (EOR) program—referred to as "Phase I." The sections of formation 200 that is saturated with fluid injected in Phase I are shown in the cross-hatch shading, such as cell 230. In Phase I, the injected fluids have been injected for some period such that the fluid has broken through to the producer wells, including producer wells 220 and 222. The unshaded section of formation 200 represent the unswept oil portions. It can be seen in this example that the Phase I fluids have not efficiently displaced oil from throughout the reservoir. This may be due, for example, to reservoir heterogeneity for instance rock textural differences, regional geological properties, fluid property, and/or rock wettability variations.

FIG. 2B illustrates the reservoir 200 after initiation of a second phase of EOR or IOR, referred to herein as "Phase II." The Phase II injection scheme, in general, differs in some way to the "Phase I' scheme. The Phase II scheme is designed to more effectively sweep resident hydrocarbons from areas within the reservoir that were not effectively swept by Phase I. There are many ways that Phase II could differ from Phase I, including but not limited to the addition, deletion or change in one or more of the following: (1) chemical injection, such as surfactant, solvent, polymer, specific types of water or other chemical method; (2) a miscible gas, such as CO2, hydrocarbon gas, or other miscible gases; (3) injection of immiscible gas(s); (4) thermal fluids or steam; (5) cyclic injection methods of different frequencies; (6) vibration methods; and (7) the location or locations and/or depths of injection. In FIG. 2B, the solid-shaded cells, such as cell 236, represent regions of the reservoir formation 200 that have had significant fluid displacement by the injection fluid of Phase II.

FIG. 2C illustrates the impact of the Phase II treatment. Note that the Phase II areas have started sweeping oil from the previously unswept regions of the reservoir formation 200. Oil and possibly connate water from the unswept regions is then produced through the producer wells 220 and 222. The partially cross-hatched cells such as cell 242 show possible oil pathways to the producer wells.

The chemical analysis of the fluids produced during Phase II injection scheme will differ from those that were produced during the Phase I injection scheme. This is because the fluids originating from unswept portions of the reservoir will contain different amounts of dissolved chemicals. According to some embodiments, the described techniques are applied to the case where unswept fluids are at saturated conditions (i.e., κ=0). Examples would be Calcium or Magnesium ions in a carbonate reservoir, where oil (and water) trapped in unswept portions of the reservoir will reach a steady state chemical condition of dissolved ions.

According to some embodiments, analysis of these constituents in the produced fluid and comparison with the produced fluids from Phase I injection scheme with the method described herein, will lead to determining if the Phase II injection scheme accessed fluids from significantly different rock structures.

Figure 3:
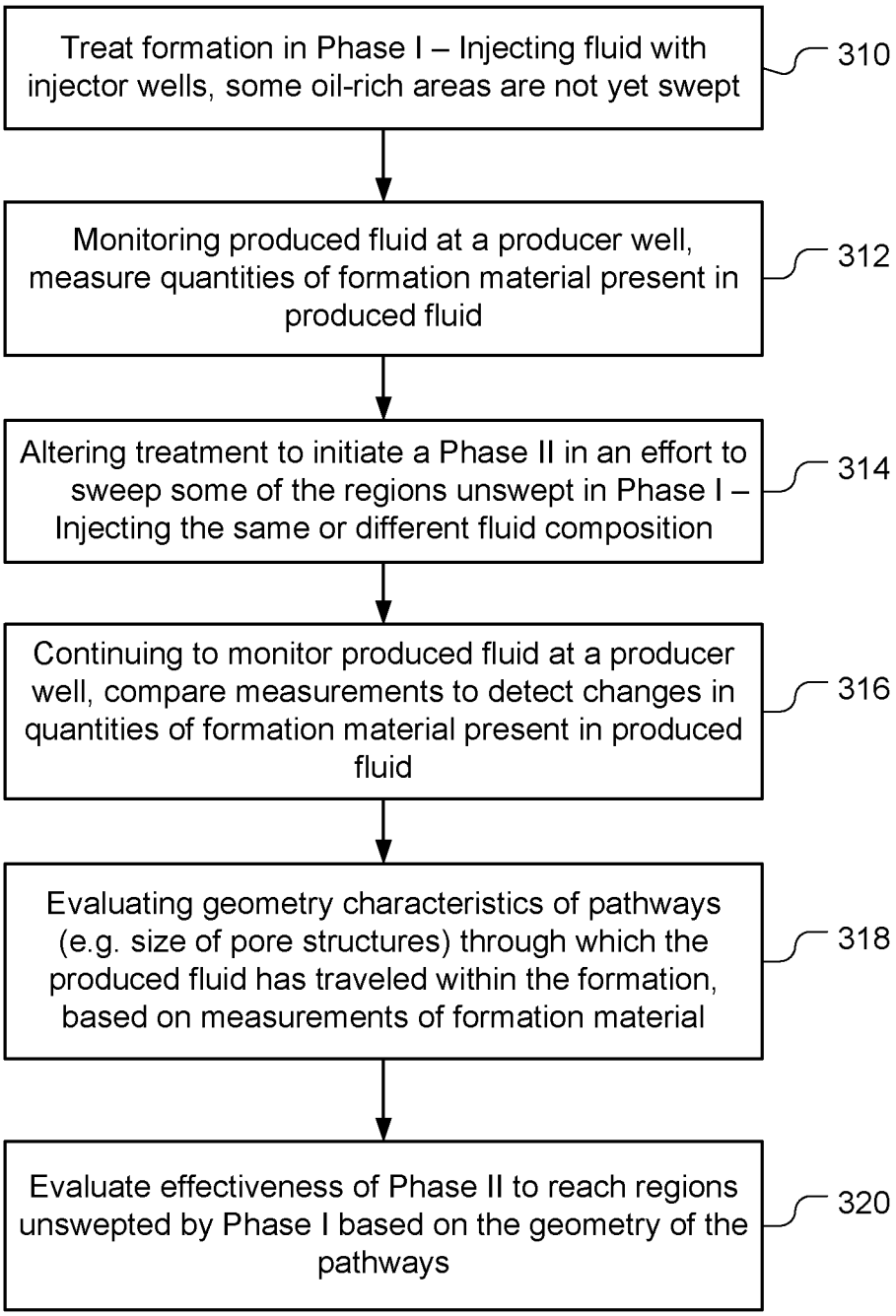
FIG. 3 is a flow chart illustrating aspects of evaluating flowpaths in a formation to evaluate effectiveness of a new treatment, according to some embodiments.

FIG. 3 is a flow chart illustrating aspects of evaluating flowpaths in a formation to evaluate effectiveness of a new treatment, according to some embodiments. In block 310 the formation is being treated by an exisiting treatment method, Phase I. According to some embodiments, the treatment includes injection of a fluid, such as brine from injector wells. From Phase I, there are some regions of oil within the formation that have not yet been effectively swept. A baseline monitoring of produced fluid is performed in block 312. The produced fluid is monitored to measure quantities of dissolved formation material present in the produced fluid during Phase I. In block 314 the treatment is altered in some significant way in an effort to enhance sweeping of oil from regions not effectively swept in Phase I. Examples of alterations include changes in injection fluid chemistry, thermal aspect and/or location of injection, as well as other examples such as described herein with respect to FIG. 2B. In block 316 the monitoring of production fluid is continued (or resumed) and the results of dissolved formation material are compared with those from Phase I. Based on changes in the dissolved formation material in the production fluid, in block 318, the techniques described herein are used to evaluate the geometry characteristics, for example the size of the pore structures, through which the produced fluid has traveled. Based on those evaluations, in block 320, a quantitative evaluation of the effectiveness of Phase II treatment compared to Phase I is made. For example, a qualitative determination can be made as to whether or not previously upswept regions of the formation are being accessed by the Phase II treatment. According to some embodiments, analysis of formation material present in the produced fluid and comparison with the produced fluids from Phase I treatment with the methods described herein, are used to calculate the percentage of produced fluid originating from unswept pore space.

Figure 4:
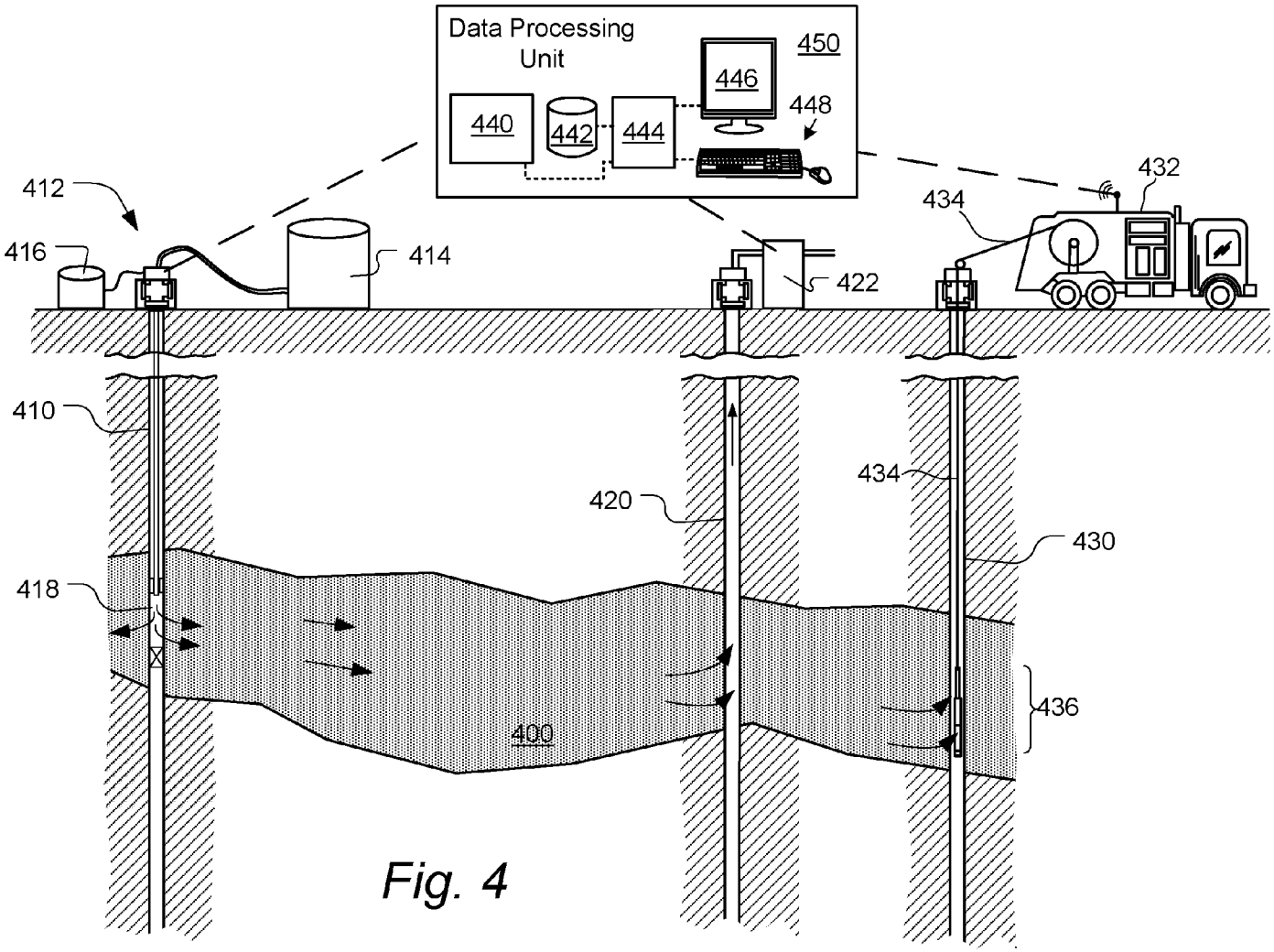
FIG. 4 is a diagram illustrating systems for evaluating flowpaths in a formation to evaluate effectiveness of a new treatment, according to some embodiments.

FIG. 4 is a diagram illustrating systems for evaluating flowpaths in a formation to evaluate effectiveness of a new treatment, according to some embodiments. An injection well 410 is used to inject treatment fluid into a formation 400, which is for example a hydrocarbon bearing rock formation. On the surface of injection well 410, wellsite 412 includes pumping and monitoring equipment for both injecting one or more fluids stored in tanks 414 and 416 as well as pressure monitoring equipment. The treatment fluid is injected via well 410 at a packer-isolated injection zone 418. According to some embodiments the fluid during a first phase of treatment is a conventional water flood, which is used to sweep some regions of the formation 400 during a first phase. According to other embodiments the first phase can be any of a number of other types of fluid treatments. Following a first phase of treatment, the treatment is altered in some significant way in an effort to reach some regions of the formation 400 that were not adequately swept during the first phase. Various examples of such treatments and alterations have been described herein.

The produced fluid is collected by one or more producer wells, for example wells 420 and 430. According to some embodiments, the produced fluid flowing into producer well 420 is monitored on the surface by monitoring equipment 422 that includes measuring pressure as well as detecting quantities of dissolved formation material present in the produced fluid. In the case of producer well 430, a downhole fluid monitoring/sampling tool 436 is being deployed via wireline 434 and wireline truck 432. According to some embodiments, sampling tool 436 is downhole fluid sampling tool such as Schlumberger's Modular Formation Dynamics Tester (MDT) tool. According to some embodiments, the tool 436 is used to monitor produced fluid for quantities of dissolved formation material.

According to other embodiments, a downhole chemical sensor deployed close to the production interval 400 (e.g., in wells 420 or 430) that is "looking" for traces of the target chemical (e.g., Calcium). According to some embodiments, a distributed chemical sensor is used that allows for chemical identification along the formation interval under production.

According to yet other embodiments, a specific chemical tracer is used. The chemical tracer is activated by the trace chemicals in the produced fluid. This tracer chemical is then released and detected either downhole or at surface. According to some embodiments, the chemical tracer is a catalyst that reacts specifically to the targeted dissolved chemical in the production stream.

According to some embodiments, during both the first and second phases, pressure measurements from the injector and producer wells, as well as measurements for quantities of dissolved formation material in the produced fluid is transmitted to a data processing unit 450. The processing unit includes a storage system 442, communications and input/output modules 440, a user display 446 and a user input system 448. According to some embodiments, the processing unit 450 may be located in the logging truck 432, or at another wellsite location. Data processing unit 450 carries out the calculations that facilitate the evaluations such as described with respect to blocks 318 and 320 in FIG. 3.

According to some embodiments the injection and monitoring can be performed from the same well. For example, a "huff and puff" operation could be employed wherein a single well (e.g., well 410, 420 or 430) is used to determine the benefit of an EOR agent. The well is used first as an injection of first EOR fluid, then, the well is produced back. The well is then used to inject a second EOR fluid, and the well produced back. Using the techniques described herein, the difference in the produced reservoir fluid chemical composition is used to indicate whether the second EOR fluid has penetrated oil in different types of pore space than the first EOR fluid.

While the subject disclosure is described through the above embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. A method of evaluating impact of a treatment scheme on production of reservoir fluids in a subterranean formation comprising:

treating the hydrocarbon bearing subterranean formation in a first treatment phase to enhance hydrocarbon recovery from the formation;

altering the treatment of the hydrocarbon bearing subterranean formation in a second treatment phase to further enhance hydrocarbon recovery, the second phase including injecting a fluid into the formation from an injection well;

monitoring produced fluid being produced from the formation at a monitoring well, the monitoring including measuring quantities of formation material present in the produced fluid; and evaluating geometry characteristics of flowpaths in the formation through which the produced fluid traveled based at least in part on the measuring of quantities of the formation material present in the produced fluid.

2. A method according to claim 1 wherein the measured quantities of formation material are dissolved components of the formation material present in the produced fluid.

3. A method according to claim 1 wherein the geometry characteristics of the flowpaths in the formation include the length of the pathways.

4. A method according to claim 1 wherein the geometry characteristics of the flowpaths in the formation include geometry of pore spaces that form the pathway.

5. A method according to claim 4 wherein the geometry of the pore spaces include a ratio of pore surface area and volume of the pore spaces.

6. A method according to claim 1 wherein the evaluating is performed prior to a time when the fluid injected during the second phase first reaches the monitoring well.

7. A method according to claim 2 further comprising evaluating effectiveness of the second phase for purposes of enhancing hydrocarbon recovery from the formation based in part on the measuring of quantities of the dissolved formation material present in the produced fluid.

8. A method according to claim 7 wherein the effectiveness evaluation is based on an evaluation of whether the produced fluid produced during second phase originates from locations in the formation that were not treated during the first phase.

9. A method according to claim 1 wherein the first treatment phase includes injecting a first treatment fluid into the formation from the injection well.

10. A method according to claim 9 further comprising monitoring pressure at the injection well and the monitoring well during both the first and second phases.

11. A method according to claim 9 wherein the monitoring of the produced fluid including measuring quantities of formation material is carried out during both the first and second phases, and the evaluating of the flowpaths is based at least in part on a comparison of quantities of formation material measured during the first and second phases.

12. A method according to claim 9 wherein the monitoring of the produced fluid is continuously carried out during the first and second phases.

13. A method according to claim 9 wherein the altering includes altering the composition of fluid injected during the first and second phases.

14. A method according to claim 9 wherein the altering includes altering at least one of the following selected from a group consisting of: chemical injection, miscible gas, immiscible gas, thermal fluids; cyclic injection, vibration, and location of injection.

15. A method according to claim 1 wherein the formation is a carbonate rock formation.

16. A method according to claim 1 wherein the produced fluid is sampled and monitored downhole in the monitoring well using a wireline tool.

17. A method according to claim 1 wherein the produced fluid is analyzed by one or more downhole chemical sensors deployed in the monitoring well.

18. A method according to claim 1 wherein the monitoring of the produced fluid at the monitoring well is performed on the surface.

19. A method according to claim 1 wherein the injection well and the monitoring well are the same well.

20. A system for evaluating impact of a treatment scheme on production of reservoir fluids in a subterranean formation comprising a processing unit configured and programmed to receive first and second datasets representing measurements of quantities of rock formation material present in fluid produced in a producing well before and after an alteration to a fluid treatment scheme of the formation, and to evaluate geometry characteristics of flowpaths in the formation through which the produced fluid had traveled based at least in part on a comparison of the quantities of rock formation material present in the fluid before and after the alteration.

21. A system according to claim 20 wherein the alteration of the fluid treatment scheme is for purposes of enhancing hydrocarbon recovery.

22. A system according to claim 20 wherein the geometry characteristics of the flowpaths in the formation include geometry of pore spaces that form the pathway.

23. A system according to claim 22 wherein the geometry of the pore spaces include a ratio of pore surface area and volume of the pore spaces.

24. A system according to claim 20 wherein the processing unit is further configured and programmed to evaluate effectiveness of the alteration for purposes of enhancing hydrocarbon recovery from the formation based in part on the comparison of the quantities of rock formation material present in the fluid before and after the alteration.

25. A system according to claim 20 further comprising a fluid monitoring system adapted and configured to make the measurements of quantities of rock formation material present in fluid produced in a producing well.

26. A system according to claim 25 wherein the fluid monitoring system includes a wireline tool adapted to make fluid samples downhole.

27. A system according to claim 25 wherein the fluid monitoring system includes a fluid analysis unit located on the surface.

28. A system according to claim 20 further comprising a fluid injection system for injecting treatment fluid into the rock formation.

29. A system according to claim 28 wherein the alteration to the fluid treatment scheme includes altering at least one of the following selected from a group consisting of: chemical injection, miscible gas, immiscible gas, thermal fluids; cyclic injection, vibration, and location of injection.

30. A method of evaluating a porous medium comprising:

flowing a first fluid though the porous medium from an inlet to an outlet;

altering the flowing of fluid through the porous medium;

monitoring pressure between the inlet and outlet;

measuring quantities of material from the porous medium present in fluid exiting the porous medium;

comparing measured quantities of material from the porous medium present in fluid exiting the porous medium before and after the alteration; and evaluating characteristics of pore space flowpaths in the porous medium through which exiting fluid has traveled based at least in part on the comparison of measured quantities of material before and after the alteration.

31. A method according to claim 30 wherein the pore space flowpath characteristics in the porous medium includes a ratio of pore surface area and volume of pore spaces.

32. A method according to claim 30 wherein the inlet and the outlet are in a single wellbore penetrating the porous medium.

* * * * *